United States Patent [19]

Melbye

[11] Patent Number: 4,979,612

[45] Date of Patent: Dec. 25, 1990

[54] SANDPAPER OR EMERY PAPER SUPPLY AND CUTTING CONTAINER

[76] Inventor: Roger H. Melbye, 22938 NE. 27th Pl., Redmond, Wash. 98052

[21] Appl. No.: 430,492

[22] Filed: Nov. 1, 1989

[51] Int. Cl.[5] ..... B26F 3/00; B65D 85/67

[52] U.S. Cl. ..... 206/216; 30/290; 83/648; 83/879; 206/362; 206/449; 269/295

[58] Field of Search ..... 206/216, 361, 362, 449, 206/564; 30/289, 290, 114, 292; 83/167, 648, 879; 269/302, 302.1, 305, 308, 320, 289 R, 295, 88

[56] References Cited

U.S. PATENT DOCUMENTS

| | | | |
|---|---|---|---|
| 248,008 | 8/1883 | Hass | 217/57 |
| 1,708,006 | 4/1929 | Aske | 217/5 |
| 1,713,495 | 5/1929 | Weindel, Jr. | 217/5 |
| 2,664,195 | 12/1953 | Mues | 206/564 |
| 3,526,038 | 9/1970 | Katz | 269/87.2 |
| 3,576,148 | 4/1971 | Katz | 269/87.2 |
| 3,884,132 | 5/1975 | Snodgrass | 83/879 |
| 4,055,892 | 11/1977 | Del Vecchio | 83/167 |
| 4,100,676 | 7/1978 | Ferguson | 30/292 |
| 4,798,372 | 1/1989 | Tingle | 269/88 |

OTHER PUBLICATIONS

"A Flat, Adjustable Lantern Slide Carrier", Science, May 23, 1952, vol. 115, No. 2995, p. 577.

*Primary Examiner*—Jimmy G. Foster
*Attorney, Agent, or Firm*—Roy E. Mattern, Jr.

[57] ABSTRACT

The professional or do-it-yourself person, i.e. woodworker or metalworker, while working on wood and/or metal projects, has a handy tool for cutting production sandpaper and emery paper, supplied commerically in sheets of approximately nine by eleven inches, and for storing both new sandpaper sheets and still usable used sandpaper sheets or emery sheets, keeping them in a ready supply of flattened sandpaper or emery sheets, avoiding any curling of the new or used sandpaper or emery sheets. This tool is a container having a top and bottom with a 180 degree opening hinge along one common side, with all the other common sides, when closed, contacting one another, to complete the full enclosure of this tool for the convenient carrying and storing thereof, while keeping the sandpaper and/or emery paper flattened. Preferably, the bottom interior is sized to hold a useful number of new nine by eleven inch production sandpaper sheets or emery paper sheets, and the top interior is sized to hold at least one nine by eleven inch production sandpaper sheet or emery sheet atop a grid configuration. If the woodworker desires to cut a nine by eleven inch production sandpaper sheet or emery sheet into smaller pieces, then he or she places this sheet over the grid configuration having parallel grooves or kerfs in two sets, with one set being perpendicular to the other set. Then using the pointed end of a nail, he or she depresses the sandpaper or emery paper sufficiently down into the groove or kerf to start a cut or complete a cut down through the sandpaper or emery paper. Other partial or complete cuts are made to size the smaller piece or pieces of sandpaper or emery paper. Partial cuts are completed by tearing apart the sandpaper or emery paper portions on either side of this partial cut formed along a groove or kerf.

13 Claims, 4 Drawing Sheets

FIG. 1
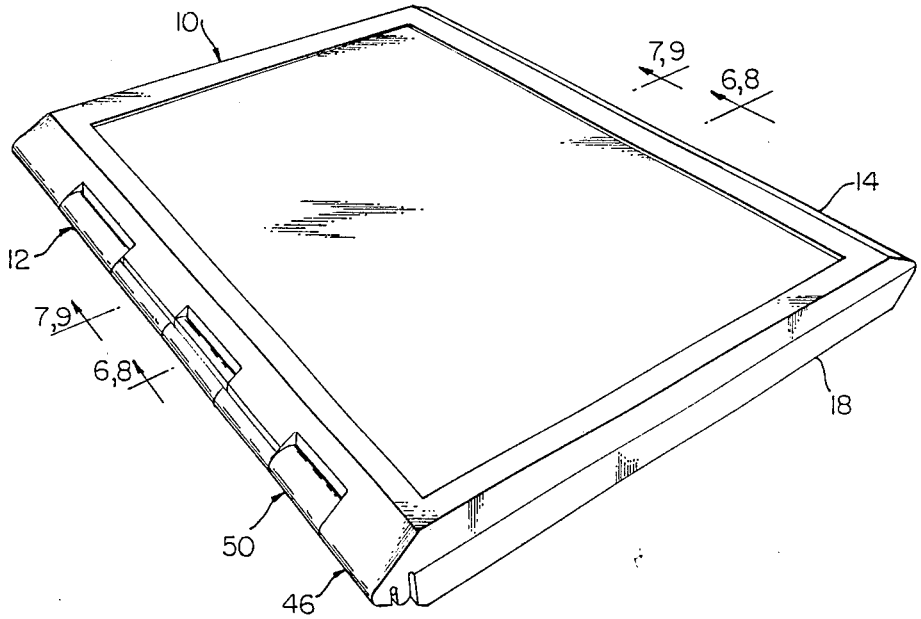
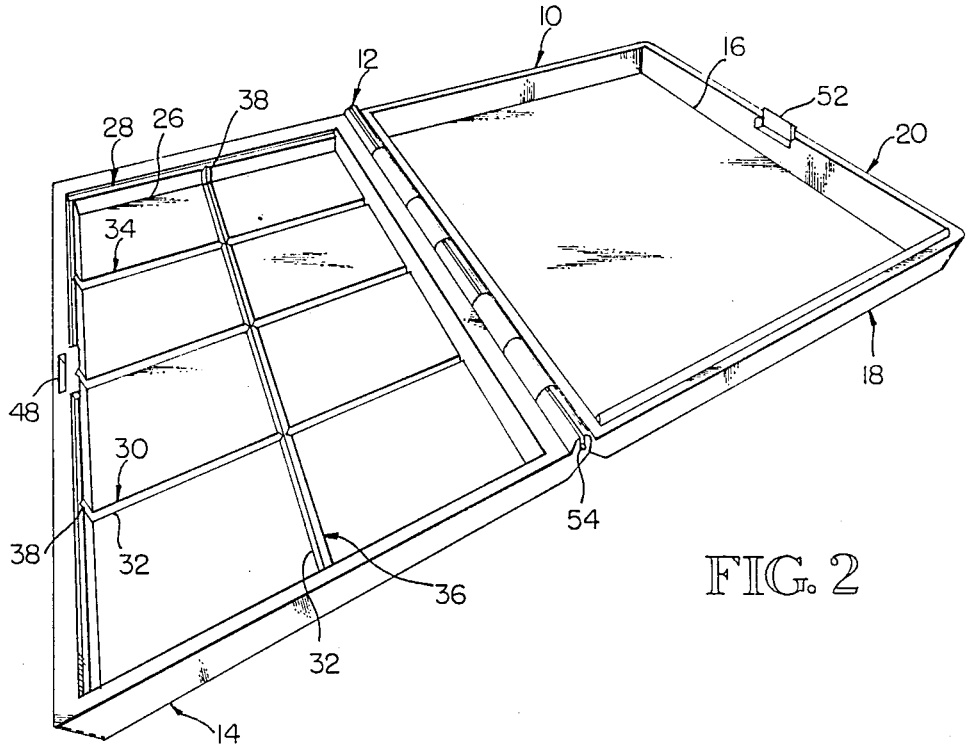
FIG. 2

SANDPAPER OR EMERY PAPER SUPPLY AND CUTTING CONTAINER

BACKGROUND

No tool to store sandpaper sheets or emery sheets, while flattened, or to provide a self contained cutting arrangement to cut small sheets of sandpaper or emery paper, is known to the Applicant.

In 1929, J. O. Aske, in his U.S. Pat. No. 1,708,006 disclosed his tool called a hone box for the convenient storage and use of a hone or sharpening stone.

In 1977, Joseph Del Vecchio, in his U.S. Pat. No. 4,055,892, illustrated and described his tool called a food dicer. Food such as jello placed in a box was diced, i.e. cut, when the lid of the box having inside depending cutters was lowered. After the cutters formed the smaller portions of jello, a removable box bottom was pulled out, permitting the jello portions to fall below on a serving platter.

SUMMARY

A sandpaper and/or emery paper supply and cutting container serves as a tool for the professional or do-it-yourself woodworker and/or metalworker, who is working on wood and/or metal projects, which require creating smooth surfaces. A shallow box container, having a hinge along one side, capable of guiding the opening of the top or lid of this box through an arc of 180 degrees, has a bottom interior to receive and/to store a selected quantity of new sheets of sandpaper or emery paper, which are generally sized approximately nine by eleven inches, and a top interior, when the cover is opened, to receive and to place a sheet of sandpaper or emery paper over a self contained grid of kerfs or grooves. When a selected paper is so placed, then a woodworker and/or metalworker uses a nail, or nail like member, via the pointed end thereof, to scribe the sandpaper or emery paper directly over a selected kerf or groove, depressing the respective paper partially and/or fully down into the kerf or groove. If parting of the selected paper is not fully accomplished, the paper is easily pulled apart on either side of the kerf or groove to complete the separation of the selected paper into smaller portions. The selectable pattern of kerfs or grooves, in parallel sets perpendicular to one another, is undertaken to provide paper sizes that are designated to be used in respective tools, such as a hand held rubber sanding block, or a hand held powered sanding machine. When closed, this sandpaper or emery paper supply and cutting container is conveniently carried or stored, and at all times the sandpaper and/or emery paper sheets are kept from curling, remaining flat as they are selected to be cut into smaller pieces and used.

DRAWINGS

The sandpaper or emery paper supply and cutting container is illustrated in the drawings, wherein:

FIG. 1 is a perspective view of the closed container, as viewed from above;

FIG. 2 is a perspective view of the opened container, as viewed from above, showing the grid of kerfs or grooves formed in the cover interior, and illustrating the receiving space for the selected paper formed in the bottom interior;

DESCRIPTION OF THE PREFERRED EMBODIMENT

Figure 3:
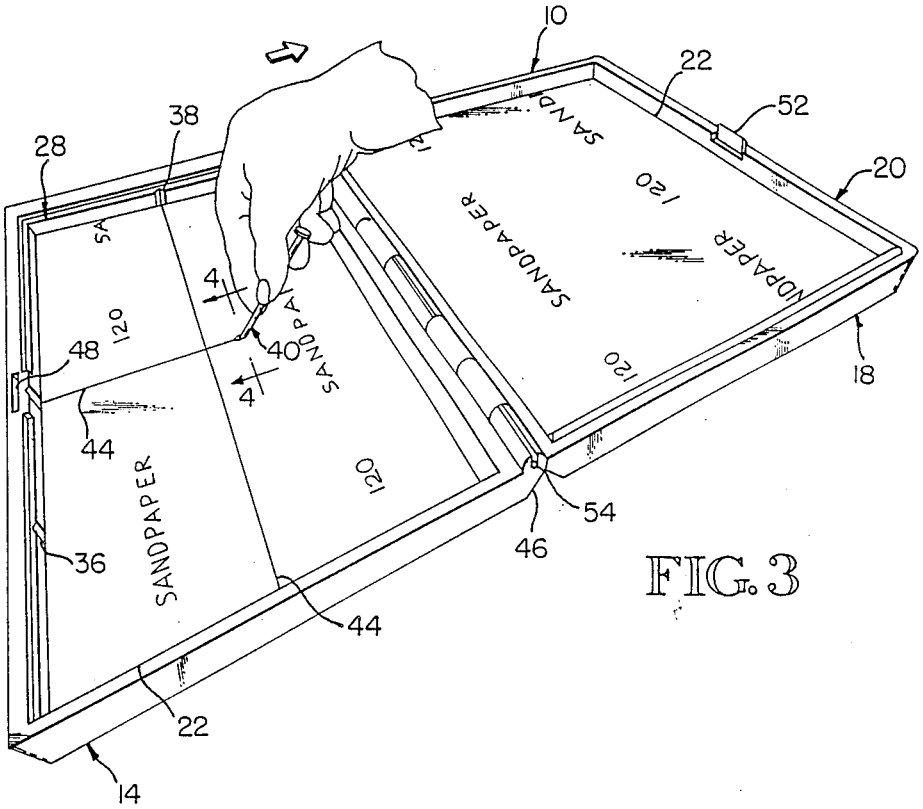
FIG. 3 is a view similar to the view of FIG. 2, illustrating how the bottom interior is storing new sheets of a selected sandpaper and/or emery paper, and showing how a sheet of sandpaper or emery paper has been placed over the grid of kerfs or grooves, and a nail is being used to depress the paper portions down into a groove or kerf to partially cut or fully cut through these paper portions.

The sandpaper and/or emery paper supply and cutting container 10 illustrated in the drawings, is a sturdy tool 10 functionally constructed to serve the professional or do-it-yourself woodworker and/or metalworker for a long time. As shown in FIG. 1, this container has a strong hinge 12 extending throughout the length of one side thereof, which permits the opening rotation of the top 14 to continue on through 180 degrees, as shown in FIG. 2.

In the interior 16 of the bottom 18, a volume or space 20 is provided to hold a selected number of essentially new sheets of sandpaper 22 or emery paper 24, as shown in FIGS. 2 and 3. In the interior 26 of the top 14, a volume or space 28 is provided to hold a selected sheet of sandpaper 22 or emery paper 24, which is placed over a selected pattern 30 of kerfs or grooves 32 arranged in horizontal groups or sets 34 and in vertical groups or sets 36, as shown in FIGS. 2 and 3.

Figure 4:
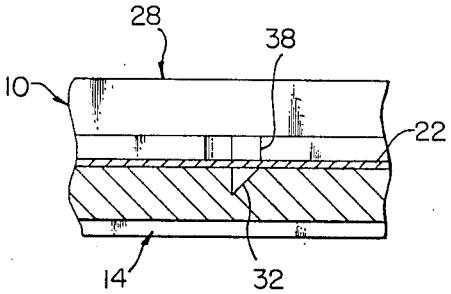
FIG. 4 is a partial cross section of a cover portion, taken along line 4—4 of FIG. 3, to illustrate a kerf or groove over which a portion of sandpaper or emery paper has been laid, and indicating in the background the kerf or groove locator formed along the interior side of the interior of this cover portion.
Figure 5:
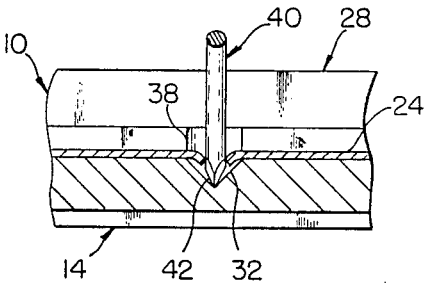
FIG. 5 is a partial cross section of a cover portion, taken along line 4—4 of FIG. 3 to illustrate how the pointed end of a nail, or nail like member has been used to depress paper portions down into the kerf or groove to cut through the selected paper along this selected kerf or groove.

How the portions of sandpaper 22 or emery paper 24 are positioned over a kerf or groove 32 is shown in FIG. 4. The kerf or groove locator 38 remains uncovered by the sandpaper 22 or emery paper 24, to indicate the location of the adjacent and aligned kerf or groove 32. How a nail 40 is used, by depressing its point 42 down through the sandpaper 22 or emery paper 24, into a kerf or groove 32, and moving it along the kerf or groove 32 to continue the full cutting of the sandpaper 22 or emery paper 24 is illustrated in FIG. 5. Depending on the strength of the sandpaper 22 or emery paper 24 and the sharpness of the nail point 42 and other possible factors, the sandpaper 22 or emery paper 24 may not be completely severed. However, when the sandpaper 22 or emery paper 24 is removed, the respective portions on either side are readily pulled apart along the scored or cutting line 44.

Figure 6:
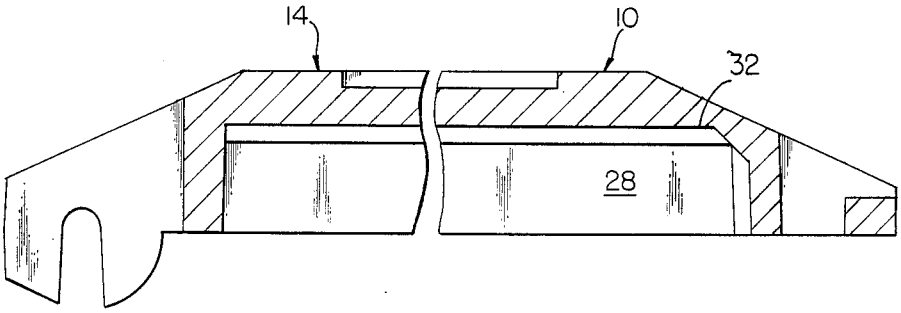
FIG. 6 is a partial cross sectional view of the top of the container before being assembled with the bottom of the container, in reference to section line 6—6 of FIG. 1.
Figure 7:
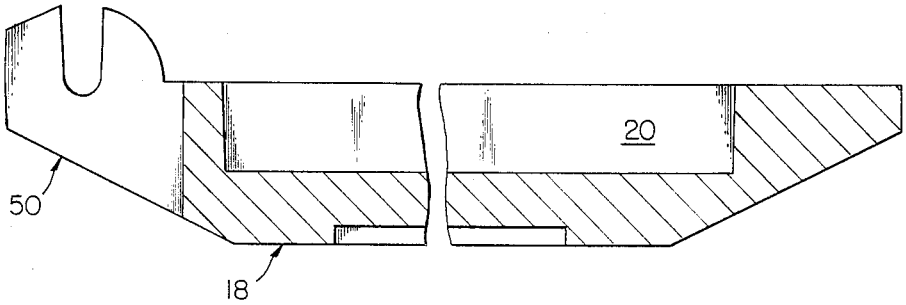
FIG. 7 is a partial cross sectional view of the bottom of the container before being assembled with the top of the container, in reference to section line 7—7 of FIG. 1.

The preferred complementing structures of the top 14 and bottom 18 of the tool 10 are illustrated, respectively, in cross-sectional views of FIGS. 6 and 7. On the right side of the cross-sectional view of FIG. 6, the hinge configuration 46 of the top 14 at this hinge section is shown. On the left side of this cross-sectional view of FIG. 6, the latch portion 48 of the top 14 is shown. Then in FIG. 7, on the right side of this cross-sectional view, the hinge configuration 50 of the bottom 18 is shown. On the left side of this cross-sectional view of FIG. 7, the latch portion 52 of this bottom 18 is illustrated.

Figure 8:
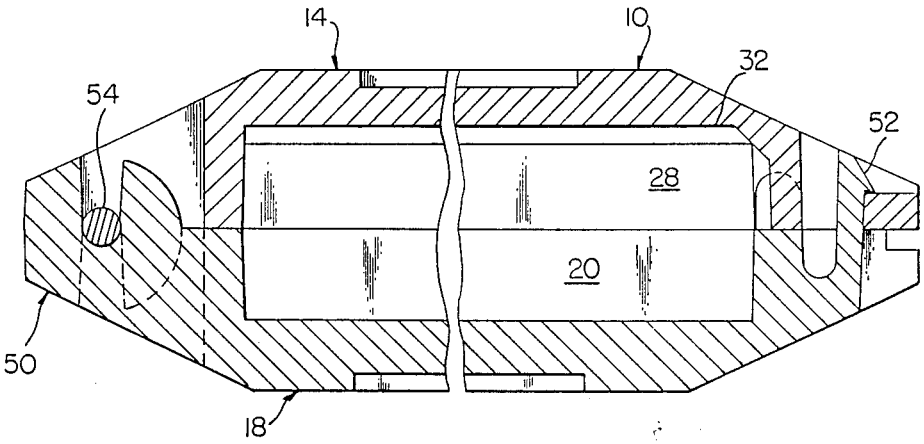
FIG. 8 is a partial cross sectional view of the assembled top and bottom of the container, in reference to section line 8—8 of FIG. 1.
Figure 9:
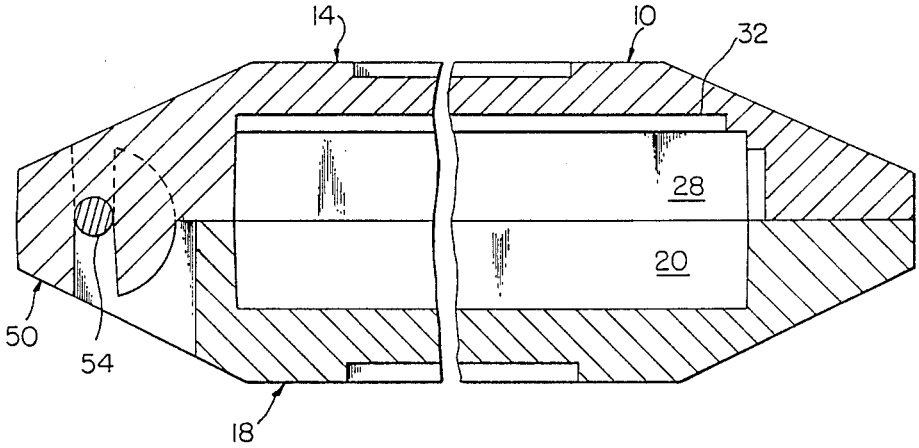
FIG. 9 is a partial cross sectional view of the assembled top and bottom of the container, in reference to section line 9—9 of FIG. 1.

FIGS. 8 and 9 are cross-sectional views of the assembled top 14 and bottom 18 taken at respective cross-sectional locales to show how the top 14 and bottom 18 complementary fit each other. A full length metal hinge pin 54 is used to interfit with the respective top hinge portions 46 and bottom hinge portions 50.

As so manufactured, assembled, and used, this sandpaper and/or emery paper supply and cutting container 10 serves as a valued tool for the professional or do-it-yourself woodworker, and/or metalworker.

I claim:

1. A sandpaper or emery paper supply and cutting container, comprising:

(a) one portion of the container having an interior volume to receive a selected number of sheets of sandpaper and/or emery paper;

(b) the other portion of the container having an interior volume to receive a selected sheet of sandpaper and/or emery paper, and having an interior planar surface structure having a gid of kerfs or grooves; and (c) these portions of the container, are placed one over the other, to keep the sandpaper and/or emery paper inside and flat.

2. The sandpaper or emery papaer supply and cutting container, as claimed in claim 1, having a nail or nail like member used in pressing against a portion of a sheet of sandpaper or emery paper, where the portion is located over a kerf or groove of the interior planar surface of the other portion, to thereby cut or partially cut the portion of the sheet.

3. The sandpaper or emery paper supply and cutting container, as claimed in claim 1, having in the other portion of the container, kerf or groove locators formed along an interior side of the interior of this other portion, to indicate the locations of the kerfs or grooves when a sheet of sandpaper or emery paper is placed over the grid of kerfs or grooves.

4. The sandpaper or emery paper supply and cutting container, as claimed in claim 1, wherein the grid has one set of parallel kerfs or grooves which are perpendicular to other set of parallel kerfs or grooves.

5. The sandpaper or emery paper supply and cutting container, as claimed in claim 1, having a hinge used in opening and closing the container through an arc of 180 degress.

6. The sandpaper or emery paper supply and cutting container, as claimed in claim 5, wherein the hinge has a through-pin, hinge portions respectively on both the one portion and other portion of the container, all hinge portions having receiving spaces to receive portions of the through-pin.

7. A sandpaper or emery paper supply and cutting container, comprising:

(a) one portion of the container having an interior volume to receive a selected number of sheets of sandpaper and/or emery paper; and (b) the other portion of the container having an interior volume to receive a selected sheet of sandpaper and/or emery paper, and having an interior planar surface structure having a grid of kerfs or grooves;

whereby the portions of the container, when placed one over the other, keep the sandpaper and/or emery paper inside and flat.

8. The sandpaper or emery paper supply and cutting container, as claimed in claim 7, wherein the grid has one set of parallel kerfs or grooves which are perpendicular to other set of parallel kerfs or grooves.

9. The sandpaper or emery paper supply and cutting container, as claimed in claim 8, having a hinge used in opening and closing the container through an arc of 180 degrees.

10. The sandpaper or emery paper supply and cutting container, as claimed in claim 9, having a nail or nail like member used in pressing against a portion of a sheet of sandpaper or emery paper, where the portion is located over a kerf or groove of the interior planar surface of the other portion, to thereby cut or partially cut the portion of the sheet.

11. The sandpaper or emery paper supply and cutting container, as claimed in claim 9, wherein the hinge has a through-pin, hinge portions respectively on both the one portion and other portion of the container, all hinge portions having receiving spaces to receive portions of the through-pin.

12. The sandpaper or emery paper supply and cutting container, as claimed in claims 7 or 8, having in the other portion of the container, kerf or groove locators formed along an interior side of the interior of this other portion, to indicate the locations of the kerfs or grooves when a sheet of sandpaper or emery paper is placed over the grid of kerfs or grooves.

13. The sandpaper or emery paper supply and cutting container, as claimed in claims 7 and 8, having a nail or nail like member used in pressing against a portion of a sheet of sandpaper or emery paper, where the portion is located over a kerf or groove of the interior planar surface of the other portion, to thereby cut or partially cut the portion of the sheet.

* * * * *